United States Patent [19]

March

[11] Patent Number: 4,974,532

[45] Date of Patent: Dec. 4, 1990

[54] SPRAY COATING APPARATUS

[75] Inventor: Timothy W. March, Westland, Mich.

[73] Assignee: Ford Motor Company, Dearborn, Mich.

[21] Appl. No.: 346,035

[22] Filed: May 2, 1989

[51] Int. Cl.[5] ..... B05B 1/28; B05B 15/04

[52] U.S. Cl. ..... 118/301; 118/323; 118/504; 901/43

[58] Field of Search ..... 118/301, 302, 323, 504, 118/213, 406; 901/43

[56] References Cited

U.S. PATENT DOCUMENTS

| | | | |
|---|---|---|---|
| 2,733,172 | 1/1956 | Brennan | 118/301 |
| 2,740,375 | 10/1957 | Diehl et al. | 118/301 |
| 3,036,550 | 5/1962 | Remington et al. | 118/301 |
| 3,296,999 | 1/1967 | Gamble | 118/301 |
| 3,318,281 | 5/1967 | Plegat | 118/302 |
| 3,584,599 | 6/1971 | Chastain | 118/301 |
| 4,009,681 | 3/1977 | Heckman et al. | 118/70 |
| 4,033,803 | 7/1977 | Coder | 156/71 |
| 4,041,898 | 8/1977 | Tajima | 118/301 |
| 4,066,807 | 1/1978 | Craig | 427/282 |
| 4,313,970 | 2/1982 | Jones et al. | 427/56.1 |
| 4,641,780 | 2/1987 | Smrt | 118/301 |
| 4,800,102 | 1/1989 | Takada | 427/197 |

FOREIGN PATENT DOCUMENTS

| | | | |
|---|---|---|---|
| 2340409 | 9/1977 | France | 118/301 |
| 2189411 | 10/1987 | United Kingdom | 118/301 |

*Primary Examiner*—James C. Housel

*Attorney, Agent, or Firm*—Roger L. May; Charles H. Ellerbrock

[57] ABSTRACT

Apparatus for spray coating a first portion of a workpiece with a coating material while masking a second portion of the workpiece bordering the first portion, so as to preclude coating of the second portion, includes a spray nozzle for spraying the coating material onto the workpiece, apparatus for moving the spray nozzle with respect to the workpiece so as to coat the workpiece along the first portion, and a mask arrangement for preventing sprayed coating material from contacting the workpiece beyond the first portion. The mask arrangement includes a rotatable mask, mounted on the spray nozzle, for translational movement therewith. The rotatable mask has an edge which moves along the workpiece adjacent the border between the first and second portions. The mask arrangement further includes a motor for rotating the mask as the mask moves with the means for spraying, so as to bring clean portions of the mask into proximity with the border. Finally, the mask arrangement includes a blade for continuously cleaning the rotatable mask such that the coating material does not accumulate thereon to produce defects in the coating sprayed on the workpiece.

14 Claims, 4 Drawing Sheets

SPRAY COATING APPARATUS

BACKGROUND OF THE INVENTION

The present invention relates to apparatus for spray coating a portion of a workpiece with a coating material and, more particularly, to such apparatus including a self-cleaning mask arrangement for preventing coating of other than the desired portion of the workpiece.

Various applications have arisen in which it is desired to spray coat only a portion of a workpiece. Masking tapes of special design, such as shown in U.S. Pat. No. 4,313,970, issued Feb. 2, 1982, to Jones et al, and in U.S. Pat. No. 4,033,803, issued Jul. 5, 1977, to Coder, have been developer to facilitate manual masking of a workpiece. In one application, it was desired to coat the lower portion of an automobile body with a layer of polyvinyl chloride material to protect the body from stone chips which may be thrown against it as the automobile is driven. To prevent extraneous coating of the upper portion of the vehicle body, the upper portion was covered with paper which was taped in place, with tape running along the periphery of the paper.

Several problems have been encountered with this manual masking approach. First, a phenomenon known as black lining has occurred. It is common for the coating material adjacent the edge of the material to take on a rather sharp edge as the masking tape is pulled away. The difficulty with this is that high solids paints will not adhere along the sharp edge, thus producing a stripe which is different in color than desired. Secondly, manual masking requires manual removal of the masking material. This manual demasking results in damage to an undesirably high percentage of coated workpieces. Finally, even if an acceptably coated workpiece is produced, the manual masking and demasking process is undesirably labor intensive and time consuming in nature.

Several attempts have been made to provide for limited, selective coating of a workpiece in a manner which does not require manually masking and unmasking the workpiece. Exemplary of such approaches are stencil arrangements shown U.S. Pat. Nos. 4,800,102, issued Jan. 24, 1989, to Takada, and 4,066,807, issued Jan. 3, 1978, to Craig. Both Takada and Craig recognize that it isd desirable to clean the stencils to eliminate build-up of the coating material and prevent the deterioration of the operation of the stencil which would otherwise necessarily result. Both Takada and Craig are limited to specialized, design coating applications, however.

Other coating applications have utilized spray deflectors to confine the area to be coated. U.S. Pat. No. 2,733,172, issued Jan. 31, 1956, to Brennan uses a pair of deflecting surfaces positioned to either side of a spray nozzle to confine the sprayed material to a moving web. These surfaces deflect and redirect the sprayed material onto the web. The apparatus disclosed in the Brennan patent is limited in its application to spray coating of materials that will not adhere to the deflecting surfaces, however.

It is seen, therefore, that there is a need for a spray coating process in which the workpiece need not be manually masked, but in which an acceptable coating operation is performed.

SUMMARY OF THE INVENTION

This need is met by apparatus according to the present invention for spray coating a first portion of a workpiece with a coating material while masking a second portion of the workpiece bordering the first portion, so as to preclude coating of the second portion. The apparatus includes means for spraying the coating material onto the workpiece, means for moving the means for spraying with respect to the workpiece so as to coat the workpiece along the first portion, and mask means for preventing sprayed coating material from contacting the workpiece beyond the first portion. The mask means includes a rotatable mask, mounted on the means for spraying, for translational movement therewith. The rotatable mask has an edge which moves along the workpiece adjacent the border between the first and second portions. The mask means further includes means for rotating the mask as the mask moves with the means for spraying, so as to bring clean portions of the mask into proximity with the border. Finally, the mask means includes means for continuously cleaning the rotatable mask such that the coating material does not accumulate thereon to produce defects in the coating sprayed on the workpiece.

The means for moving the means for spraying with respect to the workpiece so as to coat the workpiece along the first portion may comprise a robotic controlled support arm. The means for rotating the mask as the mask moves with the means for spraying, so as to bring clean portions of the mask into proximity with the border, includes means for rotating the rotatable mask about an axis generally orthogonal to the direction of the translational movement. The means for rotating the rotatable mask about an axis generally orthogonal to the direction of the translational movement comprises means for continuously rotating the rotatable mask. The rotatable mask preferably includes a disk-shaped shield.

The means for spraying the coating material onto the workpiece comprises a first spray nozzle for directing the coating material onto the workpiece. The means for spraying the coating material onto the workpiece may further comprises a second spray nozzle for directing the coating material onto the workpiece, simultaneously with the first spray nozzle.

The rotatable mask preferably includes a disk-shaped shield, and the principal axis of the sprayed coating material is generally parallel to the plane of the disk-shaped shield. The means for cleaning the rotatable mask comprises a material removal blade positioned in contact with the rotatable mask on the side thereof adjacent to the means for spraying the coating material, and material receiving means for receiving coating material which is removed from the rotatable mask by the material removal blade.

Apparatus for spray coating a first portion of a workpiece with a coating material while masking a second portion of the workpiece, includes spraying means for spraying the coating material onto the workpiece, means for effecting relative movement between the spraying means and the workpiece while the spraying means is spraying the coating mateiral onto the first portion, and mask means for receiving a portion of the sprayed coating material to prevent the same from coating the second portion of the workpiece. The mask means includes a rotatable mask having an edge positionable at the border between the first and second portions and mounted to remain in substantially constant translational position relative to the spraying means at least while the spraying means is spraying the coating material onto the first portion, means for rotating the mask, at least while the spraying means is spraying the coating material onto the first portion, to position clean portions of the edge of the mask means porgressively along the border, and means for cleaning the rotatable mask while the spraying means is spraying coating material onto the mask means to prevent accumulation of the coating material thereon in an amount sufficient to cause defects in the coating sprayed on the first portion of the workpiece.

The means for effecting relative movement comprises a robotic controlled support arm. The means for rotating the mask includes means for rotating the rotatable mask about an axis generally orthogonal to the direction of the relative movement. The means for rotating the rotatable mask about an axis generally orthogonal to the direction of the relative movement comprises means for continuously rotating the rotatable mask. The rotatable mask preferably includes a disk-shaped shield.

The spraying means for spraying the coating material onto the workpiece comprises a first spray nozzle for directing the coating material onto the workpiece. The spraying means for spraying the coating material onto the workpiece may further comprise a second spray nozzle for directing the coating material onto the workpiece, simultaneously with the first spray nozzle.

The rotatable mask preferably includes a disk-shaped shield, and the principal axis of the sprayed coating material is generally parallel to the plane of the disk-shaped shield. The means for cleaning the rotatable mask while the spraying means is spraying coating material onto the mask means comprises a material removal blade positioned adjacent the rotatable mask on the side thereof adjacent to the spraying means, and material receiving means for receiving coating material which is removed from the rotatable mask by the material removal blade.

Accordingly, it is an object to provide a spray coating arrangement in which it is possible to mask a portion of a workpiece and spray coat an adjacent portion of the workpiece; to provide such a spray coating arrangement in which a mask is continuously cleaned; and to provide such a spray coating arrangement in which one or more spray nozzles are used to effect coating.

Other objects and advantages of the invention will be apparent from the following description, the accompanying drawings and the appended claims.

DETAILED DESCRIPTION OF THE PREFERRED EMBODIMENTS

Figure 1:
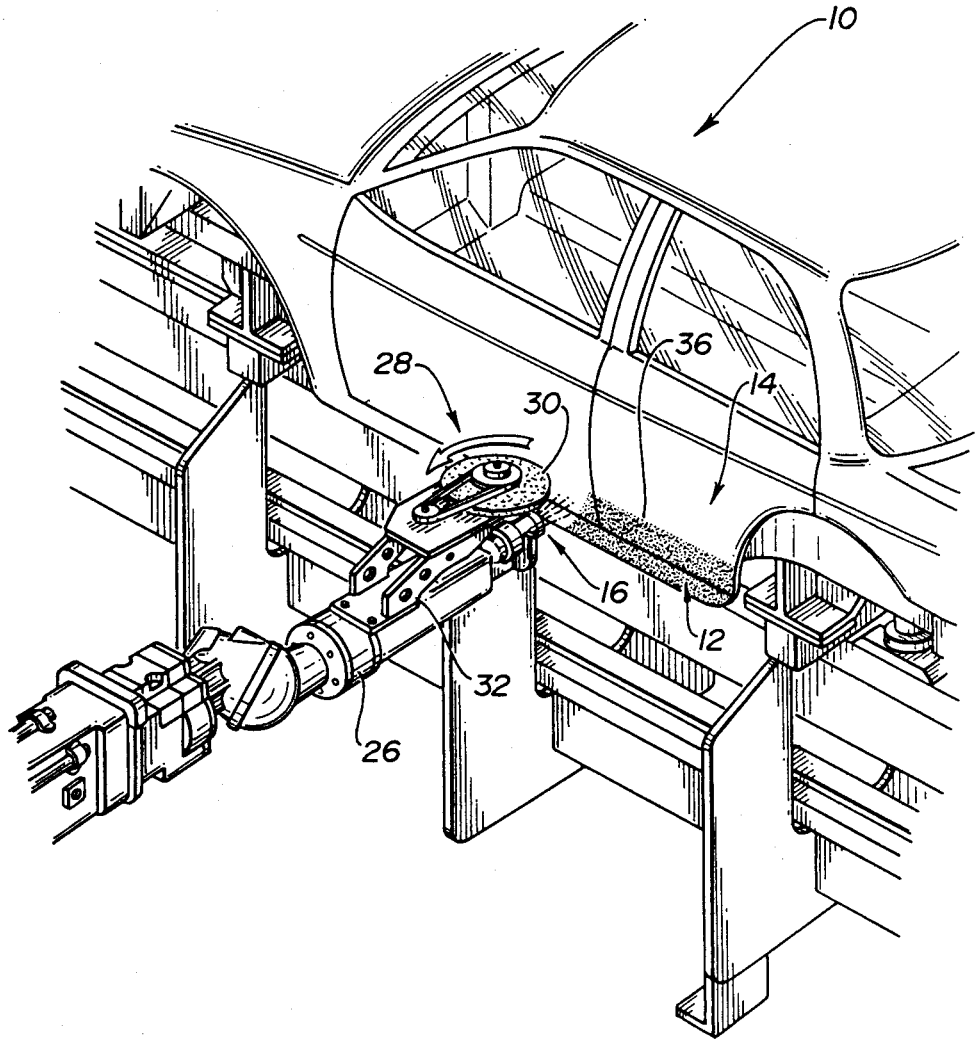
FIG. 1 is a perspective view of the spray coating apparatus of the present invention.
Figure 2:
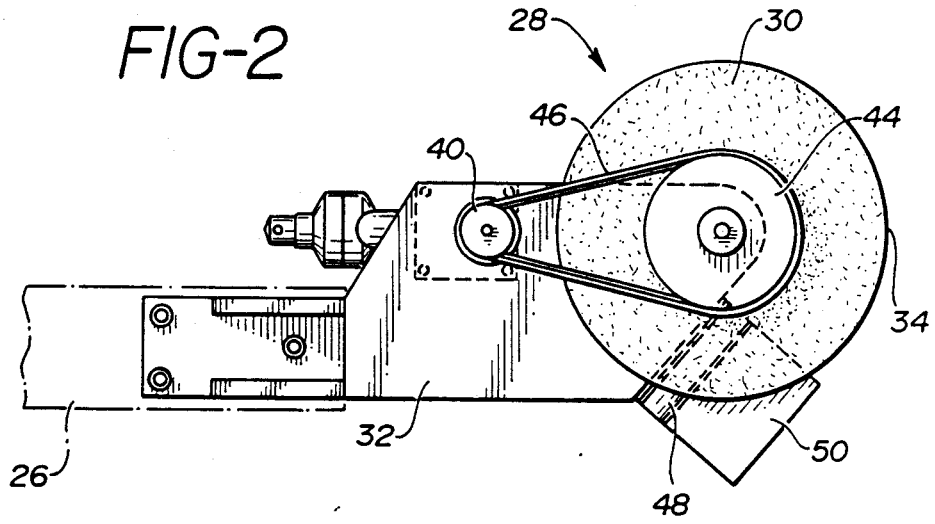
FIG. 2 is a plan view of the spray and mask arrangement of the present invention.
Figure 3:
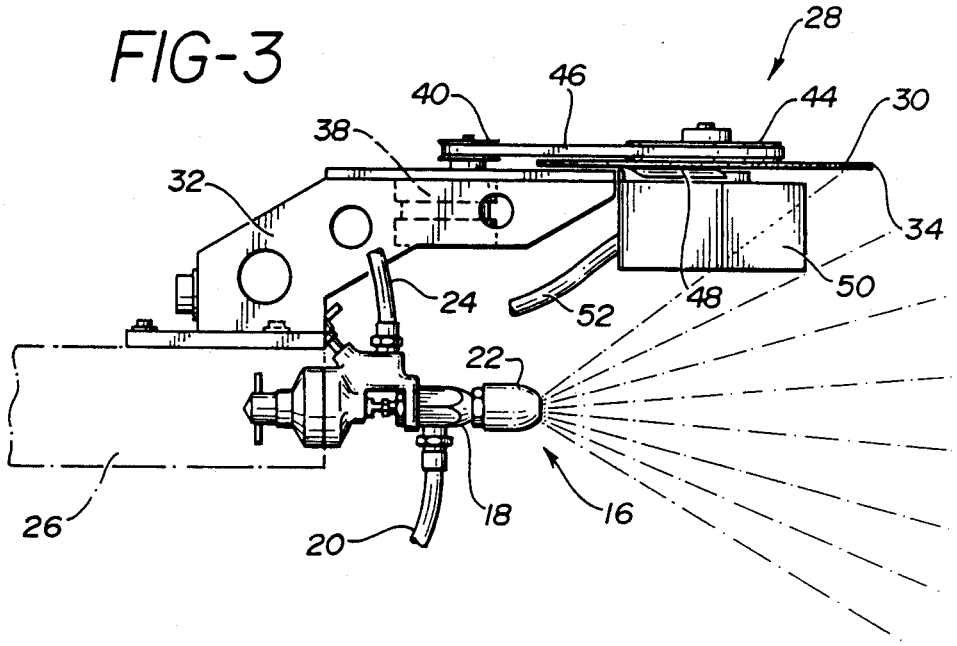
FIG. 3 is a front view of the spray and mask arrangement of the present invention.

Reference is made of FIGS. 1, 2, and 3 which illustrate the spray coating apparatus of the present invention. In FIG. 1, the workpiece 10 which is to be coated is illustrated as an automobile body. It is desired to spray coat a first portion 12 of the workpiece 10, the lower portion of the vehicle body, with a coating material while masking a second portion 14, the upper portion of the vehicle body, bordering the first portion 12. In the illustrated application, for example, the lower portion 12 may be sprayed with a coating of a vinyl material which resists chipping when struck with stones or the like during opertion of the vehicle.

A spraying means 16 for spraying the coating material onto the workpiece 10 includes a spray gun 18, a spray inlet line 20, a spray tip 22 which controls the spray pattern, an air line 24 which controls operation of the gun 18, and sources of coating material and pressurized air which are connected to lines 24 and 20, respectively. The spraying means 16 is mounted on the end of a robotic controlled arm 26 which may for example comprise a portion of a Cincinnati Milacron T3-776 Industrial Robot, providing a means for moving the spraying means 16 with respect to the workpiece 10 so as to coat the workpiece along the first portion 12. While the embodiment illustrated depicts the workpiece 10 as stationary and the spraying means being moved, it will be appreciated that all that is required is to effect relative movement between the spraying means 16 and the workpiece 10 while the spraying means 16 is spraying the coating material onto the first portion 12. If desired, the spraying means 16 may be maintained in a stationary position, and the workpiece 10 moved therepast.

A mask means 28 is provided for preventing sprayed coating material from contacting the workpiece 10 beyond the first portion 12. The mask means 28 receives a portion of the sprayed coating material and prevents the same from coating the second portion 14 of the workpiece 10. The mask means 28 includes a rotatable mask 30, mounted by means of bracket 32 on the means for spraying 16, for translational movement therewith. The rotatable mask 30 has an edge 34 which moves along the workpiece 10 adjacent the border 36 between the first and second portions 12 and 14. The mask means 28 is mounted to remain in a substantially constant translational position relative to the spraying means 16, at least while the spraying means 16 is spraying the coating material onto the first portion 12.

The mask means 28 further includes a means, comprising gear motor 38, pulleys 40 and 44, and timing belt 46, for rotating the mask 30 as the mask moves with the means for spraying 16, so as to bring clean portions of the mask 30 into proximity with the border 36. It will be appreciated that the mask is rotated, at least while the spraying means 16 is spraying the coating material onto the first portion 12. Preferably the mask 30, a disk-shaped shield, is continuously rotated about an axis generally orthogonal to the direction of the translational movement of the spraying means 16. Preferably, the principal plane of the disk-shaped shield is generally parallel to the direction in which the coating material is sprayed.

The mask means 28 further includes means for cleaning the rotatable mask 30 while the spraying means 16 is spraying coating material to prevent an accumulation of the coating material thereon in an amount sufficient to cause defects in the coating sprayed on the first portion 12 of the workpiece 10. The means for cleaning the rotatable mask 30 includes a material removal blade 48 positioned in contact with the rotatable mask 30 on the side thereof adjacent to the spraying means 16, and material receiving means comprising container 50 and coating material return line 52 for receiving coating material which is removed from the rotatable mask 30 by the material removal blade 48. If desired, the coating material removed via line 52 may be returned to the coating material supply for reuse. The material removal blade 48 and container 50 are illustrated in FIGS. 2 and 3 as a simple collection container and scraper blade mounted in a stationary position with respect to the spray apparatus. This is adequate in situations where little if any coating material is deposited on the mask 30 near its center. In other cases, however, it may be desireable to support the collection container and the scraper blade by means of a pneumatic cylinder such that the blade and container may be periodically translated radially inward with respect to the mask 30 and this area cleaned. It will be appreciated that it may not be possible to have a blade and container which are fixed in position and extend to the center of the mask 30, since this may interfer with the normal spray pattern of the nozzle 22.

Figure 4A:
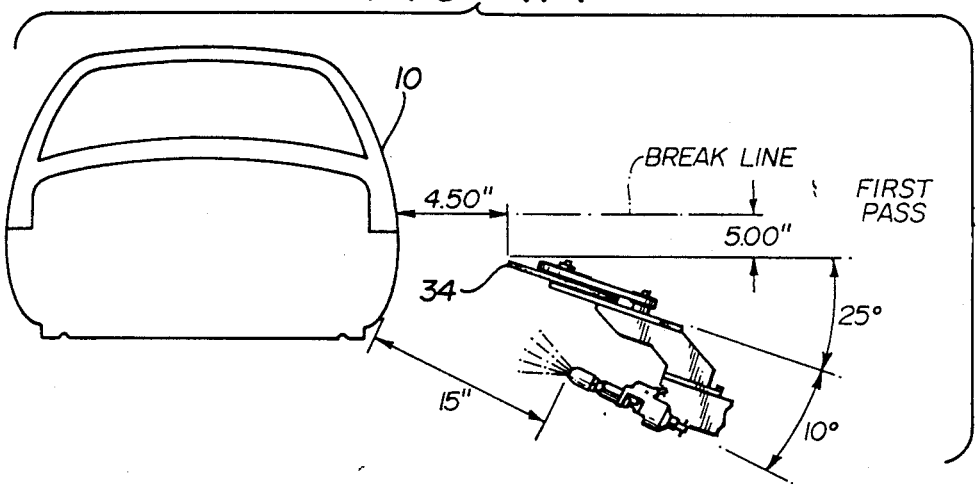
FIG. 4A, 4B, and 4C illustrate nozzle and mask orientations in a multiple pass spraying operation.
Figure 4B:
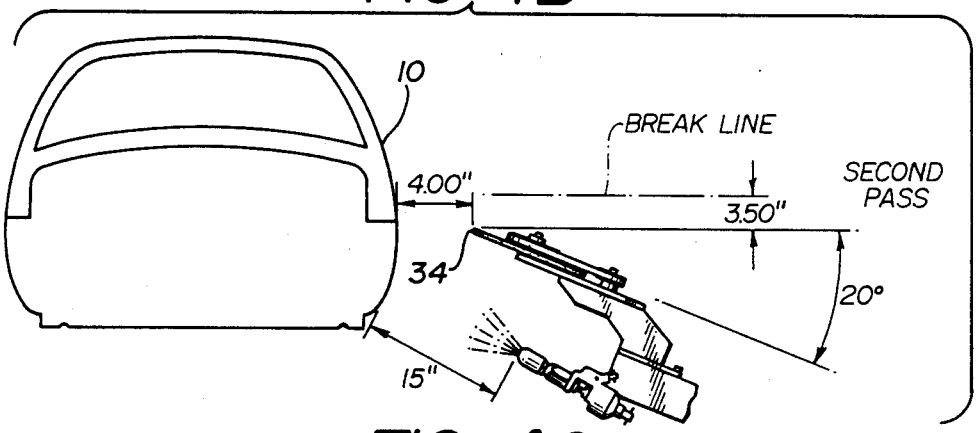
Figure 4C:
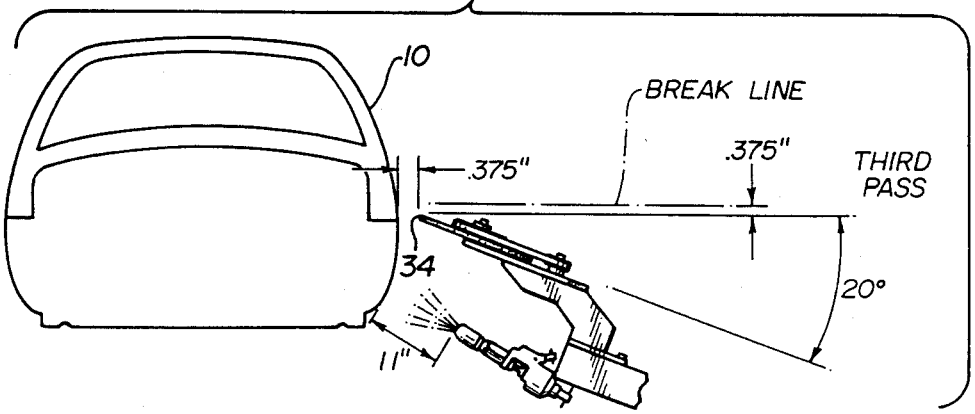

Process parameters which have been used in a multiple pass spray coating operator are illustrated in FIGS. 4A, 4B and 4C. The first two spray passes were made in slightly different orientations, with the apparatus further from the workpiece than during the third spray pass. The spray passes in which the apparatus is positioned further from the workpiece may result in a smoother transition in the durface of the workpiece between the coated portion 12 and the uncoated portion 14 at the "Break Line" corresponding to border 36. It will be noted that successive passes were made with the edge 34 of the mask 30 being both closer to the break line and closer to the workpiece. It has been found preferable in many applications, however, to simply make multiple passes with the same orientation of spray apparatus, such as shown in FIG. 4C.

Figure 5:
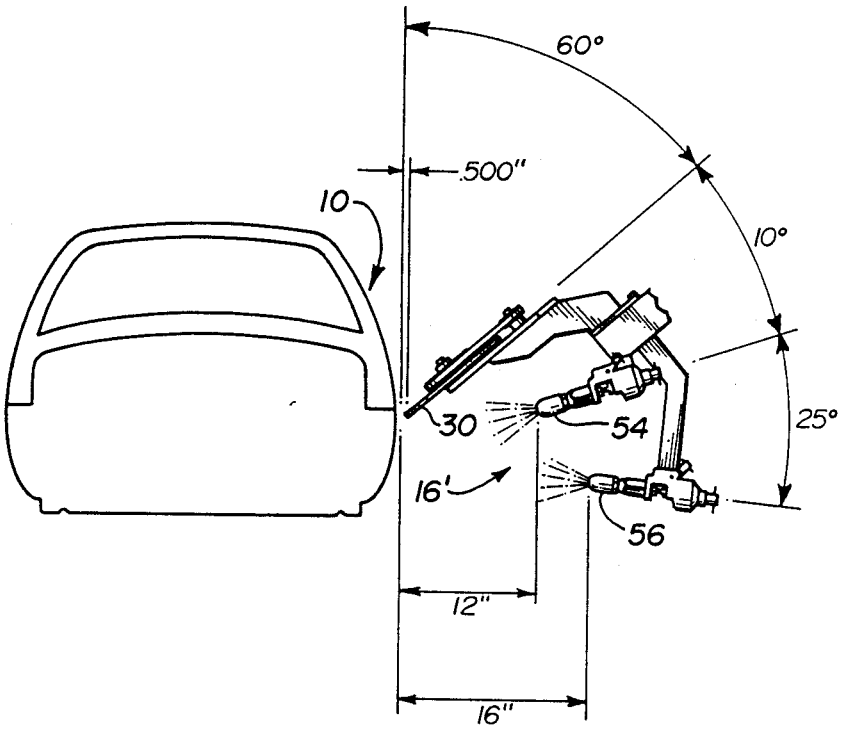
FIG. 5 illustrates a second embodiment of the present invention, incorporating multiple spray nozzles.

An alternative embodiment of the apparatus of the present invention is illustrated in FIG. 5, in which the spraying means 16' for spraying the coating material onto the workpiece 10 includes both a first spray nozzle 54 for directing the coating material onto the workpiece 10 and a second spray nozzle 56 for directing the coating material onto the workpiece 10, simultaneously with the first spray nozzle 54. Since two nozzles are spraying simultaneously, the number of spray passes required is reduced, resulting in a faster spray coating operation. It will be noted that, in FIG. 5, the direction of spray from the nozzles 54 and 56 is not generally parallel to the plane of the mask 30, and that nozzle 54 is positioned above, and closer to the workpiece than, nozzle 56. In one preferred multiple nozzle arrangement, two nozzles are positioned side by side. In either event, it is preferred that the spray patterns from the two nozzles be oriented such that theu strike the workpiece in the same area. It will be appreciated that the use of two nozzles, or more if desired, to coat a workpiece simultaneously reduces dramatically the time required to coat a workpiece, provided of course that the coating material permits application in this manner.

It has been found that the apparatus of the present invention greatly reduces the amount of time required to spray coat a portion of a workpiece as compared with a manual masking and spraying operation. The time required for two workers to mask a vehicle body, spray the lower body portion, and remove the mask material is approximately seven minutes. The embodiment illustrated in FIGS. 1–4 can effectively perform the same operation in less than one minute, with improved quality in the coating.

Having described the invention in detail and by reference to the preferred embodiments thereof, it will be apparent that other modifications and variations are possible without departing from the scope of the invention defined in the appended claims.

What is claimed is:

1. Apparatus for spray coating a first portion of a workpiece with a coating material while masking a second portion of said workpiece bordering said first portion, so as to preclude coating of said second portion, said apparatus comprising:

means for spraying said coating material onto said workpiece, means for moving said means for spraying with respect to said workpiece so as to coat said workpiece along said first portion, and mask means for preventing sprayed coating material from contacting said workpiece beyond said first portion, said mask means including a rotatable mask, mounted on said means for spraying, for translational movement therewith, said rotatable mask having an edge which moves along said workpiece adjacent a border between said first and second portions, means for rotating said mask about an axis generally orthogonal to the direction of said translational movement and generally orthogonal to the principle axis of the sprayed coating material as said mask moves with said means for spraying, so as to bring clean portions of said mask into proximity with said border, and means for continuously cleaning said rotatable mask such that said coating material does not accumulate thereon to produce defects in the coating sprayed on said workpiece, said means for continuously cleaning said rotatable mask including a material removal blade positioned in contact with said rotatable mask on the side thereof adjacent to said means for spraying said coating material, and material receiving means for receiving coating material which is removed from said rotatable mask by said material removal blade.

2. The apparatus of claim 1, in which said means for moving said means for spraying with respect to said workpiece so as to coat said workpiece along said first portion comprises a robotic controlled support arm.

3. The apparatus of claim 1, in which said means for rotating said rotatable mask about an axis generally orthogonal to the direction of said transational movement comprises means for continuously rotating said rotatable mask.

4. The apparatus of claim 3, in which said rotatable mask includes a disk-shaped shield.

5. The apparatus of claim 3, in which said means for spraying said coating material onto said workpiece comprises a first spray nozzle for directing said coating material onto said workpiece.

6. The apparatus of claim 5, in which said means for spraying said coating material onto said workpiece further comprises a second spray nozzle for directing said coating material onto said workpiece, simultaneously with said first spray nozzle.

7. The apparatus of claim 5, in which said rotatable mask includes a disk-shaped shield, and in which the principal axis of the sprayed coating material is generally parallel to the plane of said disk-shaped shield.

8. Apparatus for spray coating a first portion of a workpiece with a coating material while masking a second portion of said workpiece, said apparatus comprising:

spraying means for spraying said coating material onto said workpiece, means for effecting relative movement between said spraying means and said workpiece while said spraying means is spraying said coating material onto said first portion, and mask means for receiving a portion of the sprayed coating material to prevent said portion of the sprayed coating material from coating said second portion of said workpiece, said mask means including a rotatable mask having an edge positionable at a border between said first and second portions and mounted to remain in substantially constant translational position relative to said spraying means at least while said spraying means is spraying said coating material onto said first portion, means for rotating said mask, at least while said spraying means is spraying said coating material onto said first portion, about an axis generally orthogonal to the direction of said relative movement and generally orthogonal to the principle axis of the sprayed coating material to position clean portions of said edge of said mask progressively along said border, and means for cleaning said rotatable mask while said spraying means is spraying coating material onto said mask means to prevent accumulation of said coating material thereon in an amount sufficient to cause defects in the coating sprayed on said first portion of said workpiece, said means for cleaning said rotatable mask including a material removal blade positioned in contact with said rotatable mask on the side thereof adjacent to said means for spraying said coating material, and material receiving means for receiving coating material which is removed from said rotatable mask by said material removal blade.

9. The apparatus of claim 8, in which said means for effecting relative movement comprises a robotic controlled support arm.

10. The apparatus of claim 8, in which said means for rotating said rotatable mask about an axis generally orthogonal to the direction of said relative movement comprises means for continuously rotating said rotatable mask.

11. The apparatus of claim 10, in which said rotatable mask includes a disk-shaped shield.

12. The apparatus of claim 10, in which said spraying means for spraying said coating material onto said workpiece comprises a first spray nozzle for directing said coating material onto said workpiece.

13. The apparatus of claim 12, in which said spraying means for spraying said coating material onto said workpiece further comprises a second spray nozzle for directing said coating material onto said workpiece, simultaneously with said first spray nozzle.

14. The apparatus of claim 12, in which said rotatable mask includes a disk-shaped shield, and in which the principal axis of the sprayed coating material is generally parallel to the plane of said disk-shaped shield.

* * * * *

UNITED STATES PATENT AND TRADEMARK OFFICE

CERTIFICATE OF CORRECTION

PATENT NO. : 4,974,532

DATED : December 4, 1990

INVENTOR(S) : Timothy W. March

It is certified that error appears in the above-identified patent and that said Letters Patent is hereby corrected as shown below:

Col. 6, Line 47, "transational" should be --translational--.

Signed and Sealed this

Twenty-third Day of June, 1992

*Attest:*

DOUGLAS B. COMER

*Attesting Officer*

*Acting Commissioner of Patents and Trademarks*